United States Patent [19]

Rankin

[11] 4,065,324

[45] Dec. 27, 1977

[54] CONTACT LENS CLEANING SOLUTION

[75] Inventor: Billy F. Rankin, Rockville, Md.

[73] Assignee: Burton, Parsons and Company, Inc., Washington, D.C.

[21] Appl. No.: 751,068

[22] Filed: Dec. 16, 1976

[51] Int. Cl.[2] ..... B08B 3/10; B08B 11/00; C11D 7/10; C11D 7/14

[52] U.S. Cl. ..... 134/30; 134/26; 134/42; 252/89 R; 252/135; 252/173

[58] Field of Search ..... 252/89, 99, 109, 135, 252/173, 106, DIG. 5, DIG. 8, DIG. 14; 134/19, 26, 30, 42; 424/127, 153, 184

[56] References Cited

U.S. PATENT DOCUMENTS

| | | | |
|---|---|---|---|
| 3,171,752 | 3/1965 | Rankin | 424/329 |
| 3,240,709 | 3/1966 | Rankin | 252/106 |
| 3,311,577 | 3/1967 | Rankin | 424/78 X |
| 3,419,501 | 12/1968 | Levy | 252/135 X |
| 3,767,788 | 10/1973 | Rankin | 424/78 |
| 3,799,879 | 3/1974 | Francke | 252/89 |
| 3,829,329 | 8/1974 | O'Driscoll | 134/26 |
| 3,847,663 | 11/1974 | Shumaker | 252/135 X |
| 3,882,036 | 5/1975 | Krezanoski | 252/106 |
| 3,888,782 | 6/1975 | Boghosian | 252/106 |
| 3,908,680 | 9/1975 | Krezanoski | 134/27 |
| 3,910,296 | 10/1975 | Karageozian | 134/42 X |
| 3,912,451 | 10/1975 | Gaglia | 134/42 X |
| 3,954,644 | 5/1976 | Krezanoski | 252/106 |
| 4,013,576 | 3/1977 | Loshaek | 252/106 |

OTHER PUBLICATIONS

Weldes, H. H., et al.: "Properties of Soluble Silicates", Reprint of article from I & EC, vol. 61, Apr. 1969, pp. 29–44.

*Primary Examiner*—Dennis L. Albrecht
*Attorney, Agent, or Firm*—Fidelman, Wolffe & Waldron

[57] ABSTRACT

Silicone and/or hydrophilic soft contact lenses are freed of proteinaceous and other deposits by rubbing them with a buffered, aqueous solution of a crystalline sodium silicate, and rinsing. Heavy encrustations or deposits remaining after the above treatment may be removed from the lenses by heating them in said solution, removing them and rinsing.

13 Claims, No Drawings

CONTACT LENS CLEANING SOLUTION

The present invention relates to a cleansing composition for contact lenses and similar opthalmic apparatuses, particularly to a cleansing composition which may be utilized to remove heavy proteinaceous and other encrustations from both silicone and hydrophilic contact lenses and more particularly to a cleansing composition which comprises a sodium silicate solution to be utilized to clean soft contact lenses.

Soft contact lenses may be divided into two broad categories, namely hydrophilic and hydrophobic lenses. Hydrophobic contact lenses are usually based on elastic and flexible silicone rubber (polysiloxane), and are generally made from cross-linked dimethyl polysiloxane.

A typical preparation of a silicone contact lens is disclosed in U.S. Pat. No. 3,228,741, which is hereby incorporated by reference and comprises forming a mixture of a suitable polymerization catalyst, up to 40% of a silica filler, and the silocone polymer. Said mixture is then molded and cured by heating to cross-link the polysiloxane and to produce a finished clear lens. Increased consumer acceptance of flexible silicone rubber lenses has created a need for a cleaning solution which can be used effectively with such lenses.

Hydrophilic soft contact lenses are hydrated gel lenses which can be prepared by copolymerizing hydrophilic organic monomers containing an olefinic double bond with a small amount of a cross-linking agent which usually contains two polymerizable olefinic double bonds. These lenses are usually based on polyhydroxylated alkyl methacrylates and contain a polyhydroxylated alkyl methacrylate, such as polyhydroxyethyl methacrylate, cross-linked with, for example, an hydroxyethyl dimethacrylate.

Hydrated gel lenses can contain the following materials: (1) hydroxyethylmethacrylate or its analogs, (2) ethyleneglycol dimethacrylate or its analogs, (3) polymethylmethacrylate or its analogs, (4) polyvinylpyrrolidone, (5) traces of the respective monomers, (6) traces of inhibitors such as hydroquinone, (7) traces of catalysts such as benzoyl peroxide, and (8) water.

Many different cold detergent solutions have been formulated for cleaning contact lenses. The continued and repeated use of some of these solutions has the effect of keeping dirt from accumulating on the lenses. However, these compositions have limited efficacy on neglected, severely encrusted lenses. Hydrophilic gel lenses are particularly susceptible to severe encrustations of protein and other tear deposits because such lenses are often subjected to heat treatment, such as boiling in saline, to sterilize the lenses. The heat treatment of hydrophilic gel lenses that have not been adequately cleaned prior to heat treatment can denature any tear proteins remaining on the lenses and make subsequent removal of the proteins more difficult.

U.S. Pat. No. 3,908,680 discloses a method for cleaning heavily encrusted contact lenses by successively immersing them in two aqueous solutions. Each solution contains an active oxygen-yielding peroxy compound and preferably a chelating agent. One of the solutions is made acidic and the other basic. Although this method is reasonably effective, it suffers from the disadvantage of inconvenience because of the necessity of employing two different solutions. In effect the lenses must be cleaned twice.

U.S. Pat. No. 3,829,329 discloses the toughening of the surface and cleaning of a soft hydrophilic contact lens with hydrogen peroxide solution.

U.S. Pat. No. 3,240,709 discloses the cleansing of contact lenses with a buffered methylcellulose solution which is effective for removing crystalline tear deposits from the lenses. Presumably the contact lens is a hard lens.

A need exists therefore for a contact lens cleaning solution which can remove deposits from both hydrophilic and silicone lenses and can do so more readily than existing methods. The primary object of this invention is to provide such a cleaning composition.

In accordance with the present invention aqueous solutions of sodium silicates are utilized to quickly and easily clean proteinaceous and other encrustations from hydrophilic or silicone contact lenses.

Sodium silicate has found use in the prior art as a cleaning agent for various materials. U.S. Pat. Nos. 3,847,663 and 3,870,560 disclose the use of alkali metal silicates in the cleaning of metals.

U.S. Pat. No. 3,915,738 discloses the use of a water soluble alkali metal silicate in the preparation of a catalyst used in preparing an aqueous composition for cleaning glass windows and mirrors.

U.S. Pat. No. 3,491,029 discloses a bottle cleansing agent which is partially composed of sodium silicate.

The use of a sodium silicate solution to clean contact lenses is unprecedented and the ability with which it removes proteinaceous and other tear deposits therefrom is entirely unexpected in view of the prior art.

Soluble silicates are composed of varying proportions of sodium oxide, silica and water. Depending on their composition, they provide a wide range of chemical and physical properties. Sodium silicates are manufactured by combining alkali and a specially selected silica at high temperatures. The resulting product is a glass which can be dissolved by special processes to produce the various silicate solutions.

Theoretically, silica and alkali can be combined in all proportions above 1:1, but present products do not exceed a silica to alkali ratio of about four to one by weight because of the very low solubility of fused silicates above this ratio. The compositions of crystalline silicates that are definite chemical compounds can be identified by specific formulas. For example, anhydrous metasilicate is designated as $Na_2SiO_3$. Most silicates, however, are glassy combinations of alkali and silica, best identified by the ratio of components, e.g., a silicate with a weight ratio of 3.22 parts silica and 1 part alkali: $SiO_2/Na_2O$ of 3.22.

Since a molecule of $Na_2O$ weighs very nearly the same as a molecule of $SiO_2$, the molecular ratio and weight ratio are very nearly equal. Consequently, it has become standard practice to use weight ratios for sodium silicates more siliceous than the metasilicate (1:1). The silicates of alkalinity greater than $SiO_2/Na_2O = 1.60$ are not glasses but are definite crystalline compounds of fixed composition. Sodium metasilicate, sodium sesquesilicate and sodium orthosilicate are examples of such silicates.

All sodium silicates are alkaline in reaction. The buffer capacity, i.e., the ability of the solution to resist changes in pH, increases with increasing proportions of soluble silica. Dilute silicate solutions will maintain a fairly constant pH despite the addition of acid.

According to the present invention a dilute solution of a crystalline sodium silicate is formulated in water, and the pH is adjusted to approximately 7.0, to form a contact lens cleaning solution.

Suitable crystalline sodium silicates include sodium orthosilicate, sodium metasilicate and sodium sesquisilicate, such as those marketed by the Philadelphia Quartz Co., Valley Forge, Pennsylvania.

The soluble silicate is preferably incorporated into the solution to the extent of 0.1 to 5 percent by weight, most preferably 0.5 to 1 percent by weight.

Any adjustments to the pH of the silicate solutions are made by the addition of dilute hydrochloric acid thereto until isotonic pH is achieved. Buffering of the solution is unnecessary, a further advantage over prior art cleaning solutions.

Since sodium silicate is precipitated from solution by most salts of the heavy metals, such as calcium, magnesium, aluminum, titanium, copper and lead, the water used to prepare the cleaning solution of the present invention should be deionized or distilled.

Contact lenses may be cleaned with the solution of the present invention by applying a few drops of said solution to the lens, rubbing the lens between the thumb and forefinger and rinsing the lens with water. For removing heavier encrustations the lenses may be heated in the cleaning solution and rinsed with water. The quantity of solution employed should be sufficient to completely cover the lenses and is thus dependent on the size and shape of the container employed. Therefore, any convenient volume is suitable, although 5 to 25 ml is usually sufficient per pair of lenses to avoid wasting the solution. The solution containing the immersed lenses is heated to a temperature of from 40° to 100° C for 1 to 5 minutes. Heating to boiling is preferable by virtue of its convenience.

For a clearer understanding of the invention, specific examples are set forth below. These examples are merely illustrative and are not to be understood as limiting the scope and underlying principles of the invention in any way. All percentages are by weight.

EXAMPLE 1

A 0.5% solution of sodium sesquisilicate (Metso 99, Philadelphia Quartz Company, Valley Forge, Pennsylvania) was prepared in deionized water, and the pH of the solution was adjusted to approximtely 7.0 with dilute hydrochlroic acid.

Silicone contact lenses heavily encrusted with deposits were placed in 5 ml of the above solution and heated to boiling for three minutes. The lenses were removed from the solution and rinsed thoroughly with deionized water. Upon examination the lenses were found to be free of deposits.

EXAMPLE 2

Silicone lenses less heavily encrusted than those of Example 1 were cleaned by digital manipulation with a few drops of the solution of Example 1 and rinsed with deionized water. The lenses were found to be free of deposits.

EXAMPLE 3

Example 2 was repeated with additional silicone lenses encrusted with deposits. After digital manipulation and rinsing with deionized water, some deposits remained on the lenses. The partially cleaned lenses were then subjected to the heat treatment of Example 1 and rinsed. Upon examination, the lenses were found to be free of deposits.

EXAMPLE 4

Examples 1 to 3 were repeated with encrusted hydrophilic lenses. Upon examination the lenses were found to be free of deposits.

EXAMPLE 5

Examples 1–4 were repeated with an aqueous solution of sodium metasilicate. The lenses were freed of deposits as readily as with sodium sesquisilicate solution.

EXAMPLE 6

Examples 1–4 were repeated with an aqueous solution of sodium orthosilicate. The lenses were freed of deposits as readily as with sodium sesquisilicate solution.

While the particular compositions and process herein described are well adapted to carry out the objects of the present invention, it is to be understood that various modifications and changes may be made and this invention is of the scope set forth in the appended claims.

What is claimed is:

1. A solution for cleaning hydrophobic silicone or hydrophilic soft contact lenses, which solution comprises sodium sesquisilicate dissolved in deionized or distilled water to the extent of 0.5% by weight and sufficient dilute hydrochloric acid to achieve a pH of approximately 7.0.

2. A method of cleaning proteinaceous and other tear deposits from soft contact lenses which method comprises applying to said lenses a few drops of an aqueous solution containing from about 0.1–5% crystalline sodium silicate, said solution having an isotonic pH of about 7.0, rubbing the lenses with the fingers and rinsing with water.

3. The method of claim 2 wherein the soft contact lenses are hydrophobic or hydrophilic soft contact lenses.

4. The method of claim 2 wherein the crystalline sodium silicate is selected from the group consisting of sodium orthosilicate, sodium metasilicate and sodium sesquisilicate.

5. A method of cleaning proteinaceous and other deposits from hydrophobic or hydrophilic soft contact lenses which method comprises applying to said lenses a few drops of an 0.5% solution of sodium sesquisilicate in deionized or distilled water, adjusted to approximately pH 7.0 with dilute hydrochloric acid, rubbing said lenses with the fingers and rinsing with deionized or distilled water.

6. A method of cleaning proteinaceous and other tear deposits from soft contact lenses which method comprises heating said lenses in an isotonic aqueous solution having a pH of about 7.0 and containing about 0.1–5% of a crystalline sodium silicate, removing the lenses and rinsing the lenses with deionized or distilled water.

7. The method of claim 6 wherein the soft contact lenses are either hydrophobic or hydrophilic soft contact lenses.

8. The method of claim 6 wherein the crystalline sodium silicate is selected from the group consisting of sodium orthosilicate, sodium metasilicate and sodium sesquisilicate.

9. The method of claim 6 wherein the crystalline sodium silicate is present to the extent of .5 to 1 percent by weight in a buffered aqueous solution.

10. The method of claim 6 wherein the solution containing the lenses is heated to a temperature of from about 40° to 100° C.

11. The method of claim 10 wherein the solution containing the lenses is heated for 1 to 5 minutes.

12. The method of claim 6 wherein the lenses are immersed in a quantity of said solution ranging from 5 to 25 ml.

13. A method of cleaning proteinaceous and other deposits from hydrophobic or hydrophilic soft contact lenses which method comprises heating said lenses at 100° C for three minutes in about 5 ml of an 0.5% solution of sodium sesquisilicate in deionized or distilled water, adjusted to approximately pH 7.0 with dilute hydrochloric acid, removing said lenses and rinsing said lenses with deionized or distilled water.

* * * * *